US005743507A

United States Patent [19]

Rushing

[11] Patent Number: 5,743,507

[45] Date of Patent: Apr. 28, 1998

[54] UNIVERSAL PICTURE HANGER WITH WALL STUD MOUNTED HANGER BASEPLATE

[76] Inventor: S. Everett Rushing, 5417 Robinson Rd. Ext., Jackson, Miss. 39204

[21] Appl. No.: 698,705

[22] Filed: Aug. 16, 1996

[51] Int. Cl.[6] ..... A47G 1/16

[52] U.S. Cl. ..... 248/495; 248/480; 248/286.1; 403/71

[58] Field of Search ..... 248/489, 495, 248/476, 479, 447.1, 480, 286.1, 287.1, 295.11, 296.1, 497, 298.1, 918; 40/757, 759; 403/71, 66, 80, 395, 389, 384

[56] References Cited

U.S. PATENT DOCUMENTS

| | | | |
|---|---|---|---|
| 344,883 | 7/1886 | Trow | 248/295.11 |
| 840,188 | 1/1907 | Adams | 248/286.1 X |
| 1,217,960 | 3/1917 | Klorer | 248/296.1 X |
| 1,430,379 | 9/1922 | Hubbrell | 248/480 X |
| 1,571,097 | 1/1926 | Redman | 248/286.1 |
| 1,848,064 | 3/1932 | Oishei | 248/480 |
| 2,847,177 | 8/1958 | Ronan . | |
| 3,074,680 | 1/1963 | Stewart | 248/489 X |
| 3,361,404 | 1/1968 | Lohr . | |
| 3,377,117 | 4/1968 | Biscow | 248/480 X |
| 3,452,976 | 7/1969 | Ross | 248/286.1 X |
| 3,709,585 | 1/1973 | Tsai | 248/480 X |
| 4,641,807 | 2/1987 | Phillips | 248/480 |
| 4,712,870 | 12/1987 | Robinson et al. | 248/918 X |
| 5,069,411 | 12/1991 | Murphy | 248/495 X |
| 5,182,675 | 1/1993 | Arbisi et al. . | |
| 5,342,014 | 8/1994 | Wilson | 248/495 X |

FOREIGN PATENT DOCUMENTS

| | | | |
|---|---|---|---|
| 16551 | 7/1909 | United Kingdom | 248/480 |

*Primary Examiner*—Derek J. Berger
*Assistant Examiner*—Stephen S. Wentsler
*Attorney, Agent, or Firm*—Sughrue, Mion, Zinn, Macpeak & Seas, PLLC

[57] ABSTRACT

A wall stud mountable baseplate has a wall stud mounted to a front surface of the baseplate and extending perpendicular thereto. A nut is threadably mounted to the bolt and an elongated picture hanging rod has a hanging lug at an outboard end thereof and is rotatably and longitudinally adjustably mounted on said threaded bolt with a threaded nut locking the picture hanging rod at an angularly adjustable position and the hanging lug at a radially adjusted position relative to the bolt. Alternatively, the bolt may be rotatably mounted to the hanger baseplate and may carry a slot slidably receiving the picture hanging rod with a threaded nut frictionally locking the picture hanging rod to the baseplate at a selected longitudinal and rotatable position relative to the hanger baseplate.

1 Claim, 3 Drawing Sheets

UNIVERSAL PICTURE HANGER WITH WALL STUD MOUNTED HANGER BASEPLATE

FIELD OF THE INVENTION

This invention relates to a universal picture hanger, and more particularly to a universal picture hanger having a baseplate which may be mounted to an interior wall overlying a wall stud and fixed thereto, and rotatably mounting a longitudinally extendable elongated picture hanging rod terminating in a hanging lug at the outboard end thereof.

BACKGROUND OF THE INVENTION

The precise vertical and horizontal positioning of a picture upon an interior building wall is difficult to obtain, and almost impossible to achieve exactly at the correct picture suspension position desired.

U.S. Pat. No. 4,641,807 to Orville Phillips, issued Feb. 10, 1987, entitled "THREE-DIMENSIONALLY ADJUSTABLE PICTURE HANGER" has attempted to solve that problem by providing a singular body plate, or an assembly of two, three or like triangular shaped body plates which are superimposed one on the other, and in which each body plate is rotatable about a mounting point and translatable through movement over a body plate mounting screw, while carrying a picture hanging stud or lug at an apex of the triangular shaped plate or plates in line with an elongated slotted opening receiving the mounting screw at the mounting point upon the wall. Such arrangement is complex, and even in the arrangement where three body plates are provided, has only a limited range of adjustment for the picture hanging lug on the outermost of the series of body plates, remote from the body plate in contact with the building wall.

It is therefore a primary object of the present invention to provide an adjustable suspension support or universal picture hanger which permits the exact desired position of the picture hanging lug remote from a baseplate, which baseplate is fixedly mounted to the wall and preferably overlying a vertical wall stud, while readily permitting readjustment of the hanging lug, if necessary, and which employs a common means for both selectively coupling a slidable picture hanging rod to the baseplate, and for frictionally locking the rod longitudinally and rotatably to the baseplate, thereby permitting the picture hanging lug to move through 360° of rotation about the stud mounting position of the baseplate and radially over the full extent of the length of the picture hanging rod.

Further objects and advantages of this invention will become apparent from the following description and the accompanying drawings.

SUMMARY OF THE INVENTION

A wall stud mountable baseplate having opposite front and rear surfaces includes longitudinally spaced holes for receiving screws or other means for fixedly mounting the baseplate rear surface to a building wall, with the mounting screws passing into a vertical wall stud in contact with the rear surface of a composition wall board or the like. A stud is mounted to the front surface of the baseplate and extends perpendicularly therefrom. An elongated picture hanging rod having a longitudinal axis and opposite inboard and outboard ends is provided with a hanging lug at the outboard end for carrying a suspension wire of a picture, mirror or the like to be hung by the universal picture hanger.

Preferably, the stud is externally threaded and carries a threaded nut constituting means for selectively coupling the rod to the stud along the longitudinal axis of the rod, and for frictionally locking the rod both longitudinally and rotatably relative to the stud axis to the baseplate, thereby permitting adjustment of the hanging lug through 360° rotation about the axis of the stud and radially outwardly of the stud over the major extent of the length of the picture hanging rod. Preferably, facing contacting surfaces of the rod and baseplate are textured to increase the friction therebetween. Further, the rod is preferably rectangular in cross-section.

In one form, the threaded bolt is mounted to the baseplate for rotation about the axis of the bolt. A transverse hole within the stud is sized to and slidably receives the rod, permitting adjustment radially to extend and retract the hanger lug on the outboard end of the rod relative to the bolt. The nut threaded to the bolt compresses the rod against the baseplate to frictionally lock the rod in an axially, longitudinally adjusted and angularly rotatable position.

In another form of the invention, the rod has at least one elongated slot extending along the longitudinal axis sized to and receiving the threaded bolt, with the nut external of the rod compressing the rod against the opposing surface of the baseplate.

DESCRIPTION OF PREFERRED EMBODIMENTS

Figure 1:
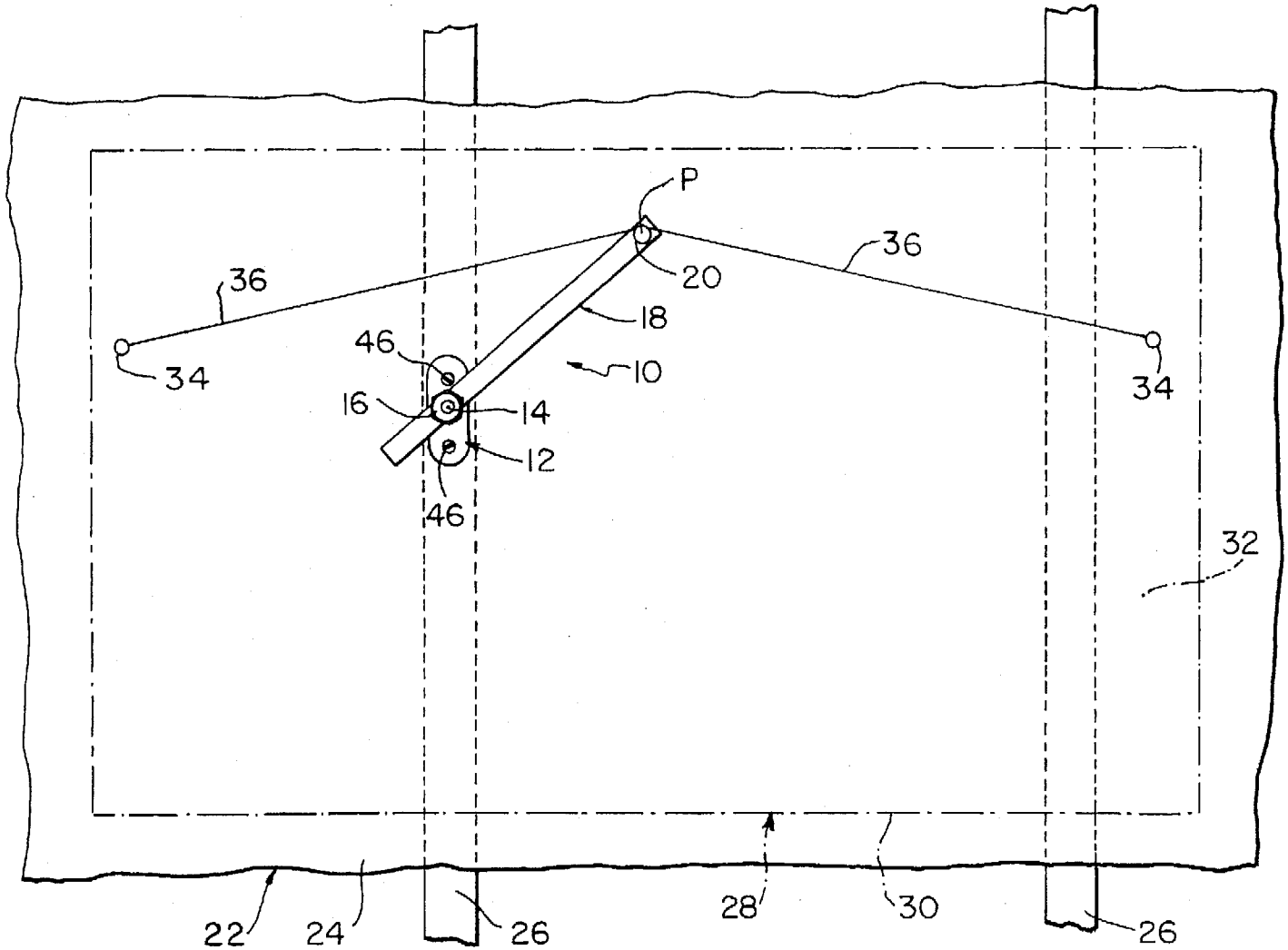
FIG. 1 is an elevational view of the universal picture hanger forming a preferred embodiment of the invention, mounted to a building wall at a building wall stud position and supporting a picture at a position vertically above and laterally to one side of the wall stud.

Referring to FIGS. 1–5, there is shown a preferred embodiment of a universal picture hanger with wall stud mounted hanger baseplate in which the universal picture hanger is indicated generally at 10, comprised of a wall stud mountable baseplate indicated generally at 12, an externally threaded stud or bolt 14 which is welded or otherwise rigidly fixed to or integral with the baseplate 12 and extending perpendicular to the baseplate, an internally threaded nut 16, and an elongated picture hanging rod indicated generally at 18, the rod 18 terminating in an integral, right angle projecting picture hanging lug 20.

The schematic view of FIG. 1 shows an interior building wall 22 which is formed of a wall board section 24 fixedly mounted to a pair of vertical wall studs 26. such as 2×4's. It is desired that the picture 28 be mounted to the wall 22 at a position indicated by point P which in this case conforms to the axis of hanging lug 20. The picture 28 is comprised of a rectangular frame 30, the rear of which is shown at 32 and has mounted thereto eyed screws 34 to opposite sides carrying a length of picture wire 36 which is longer than the distance between the eyed screws 34 such that the wire takes a downwardly open V-shape when it engages the lug 20 of the universal picture hanger 10. It is important to note that the picture hanging rod 18 is of an overall length such that it covers all of the surface of wall 22 between the various vertical studs 26 and angularly about the axis of stud 14 through 360° by the nature of its makeup which will be explained in detail hereinafter.

Figure 3:
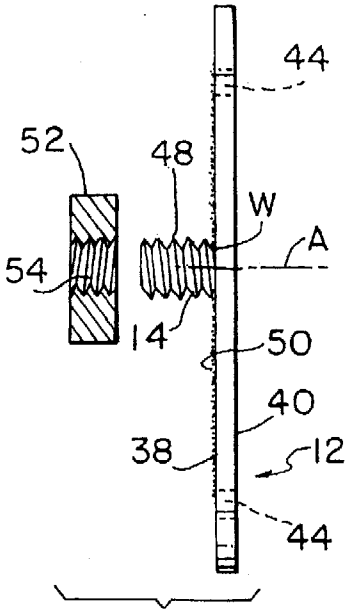
FIG. 3 is an exploded view of the hanger baseplate of FIG. 2 in side elevation, and a threadable nut as components of the universal picture hanger of FIG. 1.
Figure 2:
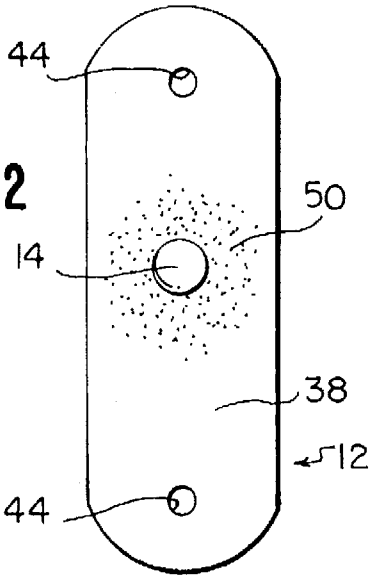
FIG. 2 is a top plan view of a hanger baseplate forming one element of the universal picture hanger of FIG. 1.

In the embodiment of FIGS. 1–5, the baseplate 12 of FIGS. 2 and 3 is of thin sheet metal stock such as steel, is of elongated form having a flat front surface 38, a flat rear surface 40 and a pair of mounting holes 44 adjacent opposite ends and at the center line of the baseplate 38. These holes 44 receive screws 46, FIG. 1, which pass through the flat front surface of the wall board 24 and project into the vertical wood stud 26 of building wall 22 so as to securely fix the baseplate 12 to the building wall. The stud or bolt 14 is shown in FIG. 3 to have a series of threads 48 on its outer periphery. The stud or bolt 14 in this embodiment is welded or otherwise fixed to the front surface 38 of the baseplate 12 as seen in FIG. 3. A portion or all of the front surface 38 of the hanger baseplate 12 is textured such as by being abraded at 50 to increase the friction of the front surface 38, principally around the stud 14 which is perpendicular to the baseplate 12. A hexagonal nut 52 is provided as the fastening or fixing means and is provided with a tapped bore 54 whose threads match the exterior threads 48 on the outer periphery of the stud or bolt 14.

Figure 4:
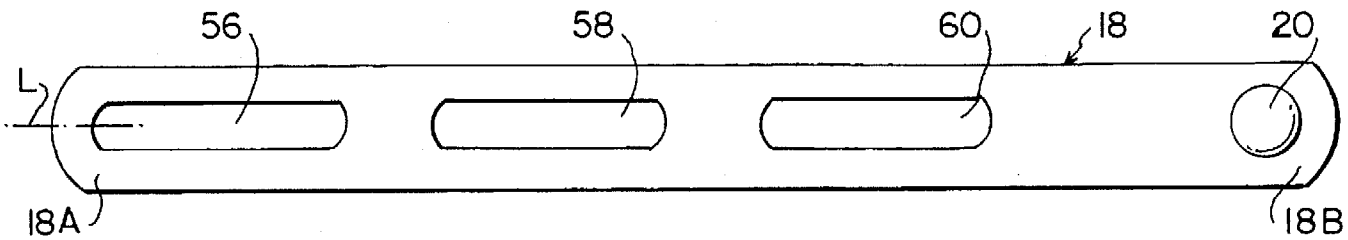
FIG. 4 is a top plan view of a picture hanging rod forming another element of the universal picture hanger of FIG. 1.
Figure 5:
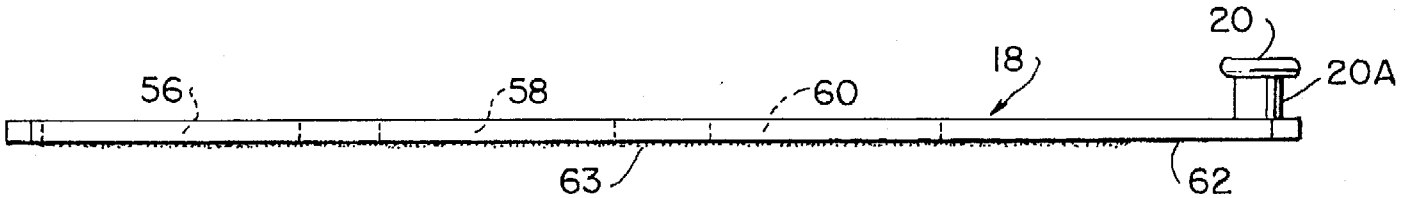
FIG. 5 is a side elevational view of the picture hanging rod of FIG. 4.

FIGS. 4 and 5 show the makeup and structure of the elongated picture hanging rod 18 which includes integrally at the outboard end 18B, opposite the inboard end 18A, a right angle, outwardly projecting hanging lug 20. Hanging rod 18 is of uniform rectangular cross-section, over its full length. A series of elongated slots 56, 58 and 60 are provided within the picture hanging rod 18 in line with the longitudinal axis L of that member and being spaced slightly from each other. This permits the adjustment in longitudinal position of the picture hanging rod 18 relative to the stud or bolt 14 on which it mounts. The three longitudinally spaced slots 56, 58 and 60 may be joined, and the slot or slots may be extended in the direction of the hanging lug 20. The slots 56, 58 and 60 are of a width slightly in excess of the diameter of the stud or bolt 14. As may be seen in FIG. 5, the flat bottom surface over the major length of the picture hanging rod 18 may be textured by being abraded or the like at 63 to increase the friction of that surface, which contacts the textured surface 50 of the hanger baseplate 12.

As may appreciated by viewing FIGS. 1–5, after the screws 46 are screwed into the wall board 24 and into the underlying studs 26, securely fixing the hanger baseplate 12 to building wall 22, the picture hanging rod 18 may be positioned on stud or bolt 14 by aligning the axis of the threaded bolt 14 with one of the elongated slots 56, 58 or 60, in this case slot 58, with the textured flat rear surface portion 63 facing the textured flat front surface 50 of the hanger baseplate, whereupon the hexagonal nut 52 is threaded onto the bolt 14 and is tightened down after the picture hanging rod 18 is extended and rotated such that lug 20 is at the desired position P. The peripheral groove 20A of the lug 20 receives the picture hanging wire 26 to hang the picture.

As may be appreciated, the rod 18 may be extended or retracted in this embodiment to the extent of the length of the elongated slots 56, 58 or 60 depending upon which one receives the stud or bolt 14. If the picture is not exactly right, both the angular position of the picture hanging rod 18 may be adjusted as well as the radial extent of the lug 20 from the pivot axis of the rod as defined by axis A of the bolt 14. Rotation of the nut releases the compressive force acting through picture hanging rod 18 on the baseplate 12 to make that adjustment. This requires mere loosening of the nut 52. However, the nut will have to be removed if the stud or bolt 14 is to receive one of the other elongated slots, either that at 56 or that at 60.

There is no necessity that the rod 18 project upwardly, it may just as well project downwardly, obliquely, or it may be oriented vertically either up or down from the position shown in FIG. 1. While preferably the picture hanging rod 18 is of rectangular strip form, and also of metal, it may be of other material and of a different configuration, although necessarily there should be conforming textured or abraded surface areas, which mate on the picture hanging rod 18 and the hanger baseplate 12.

Figure 7:
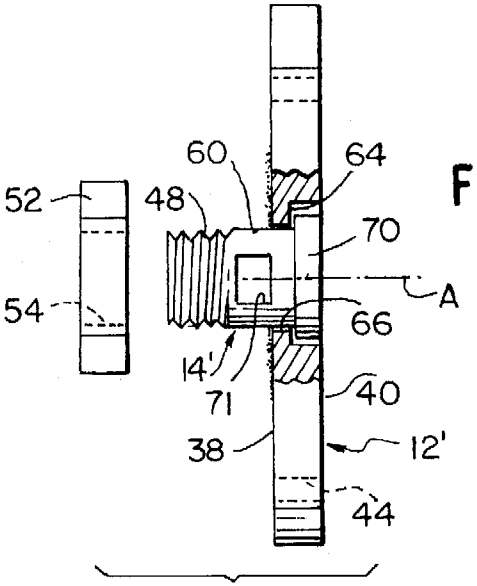
FIG. 7 is an exploded view of the hanger baseplate of FIG. 6, and a threaded nut forming components of the second embodiment of the universal picture hanger the present invention.
Figure 6:
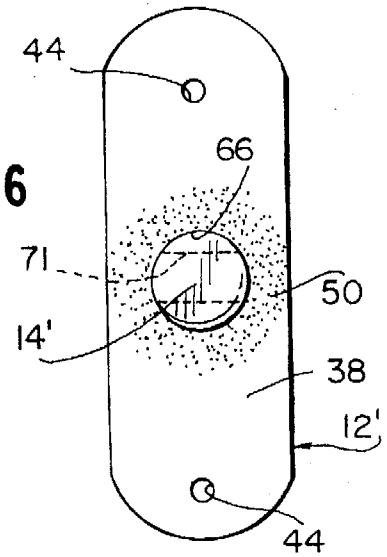
FIG. 6 is a top plan view of a hanger baseplate of a universal picture hanger forming yet another embodiment of the invention, having similar components to the universal picture hanger of FIGS. 1–5.
Figure 8:
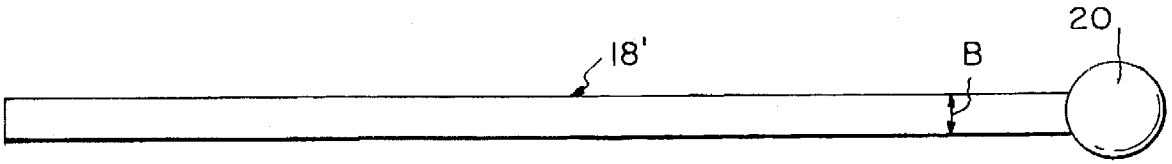
FIG. 8 is a top plan view of a picture hanging rod employed with the components of FIGS. 6 and 7.
Figure 9:
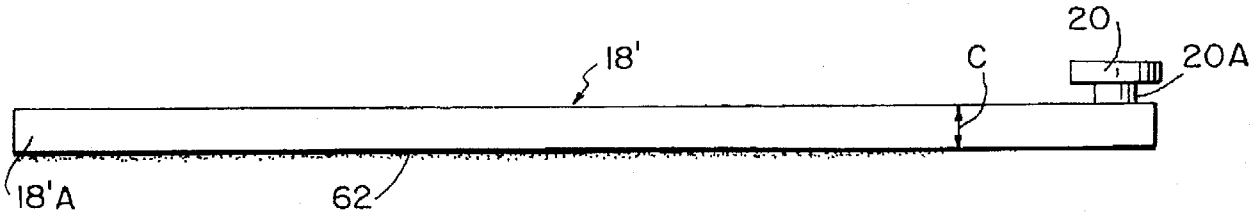
FIG. 9 is a side elevational view of the picture hanging rod of FIG. 8.

An alternate embodiment of the picture hanger is illustrated in FIGS. 6–9 with similar components having a slight modification to that of at 10 in FIGS. 1–5. Like elements bear like numerals. The hanger baseplate 12' is of similar configuration and form, but does not have a fixed, welded or otherwise attached stud or bolt. As seen in FIGS. 6 and 7, the hanger baseplate 12' is elongated, is generally rectangular in cross-section, has a textured flat surface 50 like that of the first embodiment on the front 38, however, unlike the first embodiment, there is a circular bore at 66 which is sized slightly larger than the diameter of shank 68 of a headed bolt 14' whose head 70 is larger than that of the shank 68. Like the first embodiment, the shank 68 is threaded at 48 and threadably receives a hexagonal nut 52 whose internal threads 54 match those at 48 of the shank 68. The bolt 14' is further provided with a rectangular shaped slot which passes transversely through the bolt from one side to the other, the slot 70 being centered with the axis A of the bolt 14'. The rear surface 40 of the hanger baseplate includes a circular recess 64 which receives the head 70 whose thickness is less than the depth of recess 64.

Further, the picture hanging rod 18' is of near square cross-section having a width B which is slightly less than the width of slot 70, and a height C which is slightly less than the axial length of slot 70 within the bolt shank 68. This permits the picture hanging rod 18' to have its end 18'A slid through the rectangular slot 70 to a longitudinally desirable position with lug 20 radially positioned remote from the bolt 14'. This functions to radially and longitudinally set the lug 20 on the hanger base. The picture 28 is thus mounted identically to that in FIG. 1 with the appropriate adjustments both longitudinally and radially insofar as the longitudinal adjustment for the picture hanging rod is made prior to tightening down of nut 52 so that pressure is applied against the face of rod 18' opposite that bearing the flat textured or abraded surface 62, which contacts the abraded or otherwise textured surface 50 surrounding the bore 66 within the hanger baseplate 12'.

Thus, similar to the first embodiment, the nut 52 constitutes the means for frictional locking of the rod longitudinally and rotatably to the baseplate 12', while the insertion of end 18'A of the picture hanging rod effects a coupling between the rod 18 and the bolt stud or bolt 14' in this embodiment. While elements 14 and 14' in both embodiments are in bolt form since they have external threads which mate on the internal threads 54 of the locking nut 52, it is envisioned that other means may be provided for longitudinally coupling the hanging rod 18' to the hanger baseplate 12' other than via a threaded bolt such as a nonthreaded stud and the substitution of a fixing means other than a threaded nut such as nut 52.

While the invention has been described in terms of several embodiments, various changes and modifications may be made without departing from the scope of the invention as defined by the claims appended to this specification.

What is claimed is:

1. A universal picture hanger comprising:

a wall stud mountable baseplate having opposite flat front and rear surfaces, means for fixedly mounting said baseplate flat rear surface to a building wall at a wall stud location, a stud mounted to said flat front surface of said baseplate and extending perpendicular thereto, a rectangular cross-section elongated picture hanging rod having opposed flat front and rear surfaces and opposite inboard and outboard ends, a hanging lug projecting at right angles outwardly of said picture hanging rod flat front surface at said outboard end, and common means for selectively rotatably and longitudinally coupling said picture hanging rod to said stud along the longitudinal axis of said rod and for frictionally locking said rod longitudinally and rotatably to said baseplate thereby allowing said hanging lug to adjust through 360° of rotation about said baseplate and radially over the extent of the picture hanging rod from said lug to said inboard end, and wherein said stud is mounted to said baseplate for rotation about its axis, and wherein said common means comprises a rectangular transverse hole provided within said stud and sized to and slidably receiving said rod to permit longitudinal adjustment in the position of the picture hanging rod on said stud by radially extending and retracting the hanger lug on said outboard end of said rod, and wherein a nut on said stud compresses a flat facing surface of said rod against the flat front surface of said baseplate.

* * * * *

UNITED STATES PATENT AND TRADEMARK OFFICE

CERTIFICATE OF CORRECTION

PATENT NO. : 5,743,507

DATED : April 28, 1998

INVENTOR(S) : S. Everett Rushing

It is certified that error appears in the above-identified patent and that said Letters Patent is hereby corrected as shown below:

In the Abstract, line 1, after "a", delete "wall stud" (second occurrence) and insert --bolt rotatably--.

Signed and Sealed this

Thirtieth Day of March, 1999

*Attest:*

*Attesting Officer*

Q. TODD DICKINSON

*Acting Commissioner of Patents and Trademarks*